US005682581A

United States Patent [19]

Honma et al.

[11] Patent Number: 5,682,581

[45] Date of Patent: Oct. 28, 1997

[54] PHOTOSENSITIVE BODY DRUM, METHOD FOR DRIVING THEREOF AND PHOTOSENSITIVE BODY DRUM UNIT

[75] Inventors: Susumu Honma; Jun'ichi Shibata; Arimichi Fukuda, all of Kanagawa, Japan

[73] Assignee: Fuji Xerox Co., Ltd., Tokyo, Japan

[21] Appl. No.: 422,557

[22] Filed: Apr. 14, 1995

[30] Foreign Application Priority Data

May 26, 1994 [JP] Japan ..... 6-134854

[51] Int. Cl.[6] ..... G03G 15/00

[52] U.S. Cl. ..... 399/167; 399/159; 399/411

[58] Field of Search ..... 355/211, 200, 355/210

[56] References Cited

U.S. PATENT DOCUMENTS 5,418,600 5/1995 Genovese ..... 355/200

FOREIGN PATENT DOCUMENTS

| | | |
|---|---|---|
| 59-90877 | 5/1984 | Japan . |
| 59-107357 | 6/1984 | Japan . |
| 64-4753 | 1/1989 | Japan . |
| 1-315781 | 12/1989 | Japan . |
| 2-37358 | 2/1990 | Japan . |
| 5-27467 | 2/1993 | Japan . |

*Primary Examiner*—R. L. Moses

*Attorney, Agent, or Firm*—Finnegan, Henderson, Farabow, Garrett & Dunner, L.L.P.

[57] ABSTRACT

The outer circumferential portions of the opposite ends of a cylindrical photosensitive body provided with a photosensitive layer on a substrate is supported while the photosensitive body is driven. The rotation of the photosensitive body is controlled by control members which are a roll member, a tracking roll, an electrification roll member or the like. The substrate may be shaped into a cylinder by rolling up a metal strip or a metal plate and TIG-welding a joint portion thereof.

12 Claims, 8 Drawing Sheets

PHOTOSENSITIVE BODY DRUM, METHOD FOR DRIVING THEREOF AND PHOTOSENSITIVE BODY DRUM UNIT

FIELD OF THE INVENTION

The present invention relates to a method for driving a photosensitive body, and a photosensitive body with a flange, particularly to a photosensitive body with flanges using an electro-unite tube.

DESCRIPTION OF THE RELATED ART

In a cylindrical photosensitive body (hereinafter simply referred to as "photosensitive body"), as shown in FIG. 15, a photosensitive layer is formed on a hollow cylindrical drum body (substrate) 1 (the photosensitive layer is not shown). A flange 2*a* is attached to one end of the substrate, and a rotation supporting portion 3*a* is fixed thereto. In addition, a flange 2*b* having a drive transmission portion 23 is attached to the other end, and a rotation supporting portion 3*b* is fixed thereto. It is necessary for this cylindrical drum body 1 to have a cylindrical shape which have to be superior in size accuracy and smoothness of the surface, and high in shape accuracy. Accordingly, substrates manufactured in a variety of manners have been proposed.

That is, as for substrates for photosensitive bodies, there have been proposed an extruded tube obtained by making an aluminum or aluminum-alloy ingot into a billet which is then subjected to hot extrusion, a drawn tube obtained by drawing an extruded tube at ordinary temperature, an impact ioning tube (hereinafter abbreviated to "II tube") obtained by giving cold impact extrusion to a bar billet and thereafter wiping the extruded bar billet, a punched and deep drawn tube (hereinafter abbreviated to "DI tube") formed of a metal strip or a metal plate, and the like.

These substrates are manufactured in such methods as follows.

1) A method in which the opposite ends and outer circumferential surface of an extruded tube or a drawn tube are cut so that the tube is used as it is as a substrate, or a drawn tube is annealed and then further drawn so that the drawn tube is used as a substrate (Unexamined Japanese Patent Publication No. Sho-64-4753).

2) A method in which the tube ends of an extruded tube are curled, the outer circumference of the tube is cut, and then the tube is subjected to wiping so that the extruded tube is used as a substrate, or the II tube is used as a substrate after or without being cut (Unexamined Japanese Patent Publication No. Sho-59-90877).

3) A method in which the DI tube obtained by deep drawing is cut so that the cut DI tube is used as a substrate (Unexamined Japanese Patent Publication No. Sho-59-107357).

4) A method in which an electro-unite tube or a worked electro-unite tube which is formed by high-frequency welding is subjected to roll correction, cutting or polishing, and further subjected to electrolytic polishing or anodization, so that the electro-unite tube is used as a substrate (Unexamined Japanese Patent Publication No. Hei-01-315781).

5) A method in which an electro-unite tube formed by high-frequency welding is subjected to a wiping process or a grinding, cutting or polishing process, and further subjected to electrolytic polishing or anodization so that the electro-unite tube is used as a substrate (Unexamined Japanese Patent Publication No. Hei-5-27467).

In a photosensitive body, a substrate is required to operate with its outer circumferential surface rotating smoothly about the axis of a flange which is a drive support body. As for the formation tolerance of the substrate itself, it is therefore necessary to bring a high accuracy to the concentricity with the outer diameter, the roundness of the outer diameter and the cylindricality with respect to the inner diameter as a datum (reference), that is, the total deflection with respect to the inner diameter as a datum, and to bring a minute surface roughness to the outer circumferential surface in which a photosensitive layer is formed.

An electronic photographic photosensitive drum in which a photosensitive layer is formed on a substrate manufactured thus has flanges joined to end portions of the substrate, and the photosensitive drum is with the flanges as center of rotation in use. Conventionally, the flanges are joined respectively by fitting the outer circumferential portions of the flanges into the inner circumferential portions of the end portions of the substrate. In this case, a manner of joining using a one-part or two-part adhesive such as epoxy resin, polyurethane resin, acrylic resin, etc., a manner of abrasion joining using elastic/plastic deformation by close fit after mechanical press fit, a manner of mechanical joining by insertion with a stay and a washer and nut, etc., has been adopted as the manner of joining the flange. Particularly recently, a method for bonding a flange to a substrate in order to reduce the cost is mainly used in low-price small photosensitive drums coming to be used widely.

In a photosensitive drum with flanges, generally, the performance of deflection thereof determines as to whether superior images can be obtained or not. The deflection of a photosensitive drum with flanges fitted thereto can be decomposed into various elements as shown in the following Table 1 with respect to the substrate and the flanges of the photosensitive drum. These elements are complicated with each other to constitute the deflection of the photosensitive drum with flanges.

TABLE 1

| No. | Factors forming total deflection | Specific means for improving accuracy |
|---|---|---|
| (1) | Cylindricality of an outer diameter portion of a substrate | |
| –1 | Roundness | • roll correction<br>• centerless grinding<br>• cutting when the substrate is a cut tube<br>• minute adjustment of a cutting jig inserted into the substrate |
| –2 | Straightness | • roll correction<br>• centerless grinding<br>• minute adjustment of tail pressure of a lathe when the substrate is a cut tube |
| (2) | Concentricity (uniformity) of inner and outer diameters of a fitting portion of the substrate | • giving a centering location process when the substrate is a cut tube |
| (3) | Roundness of the inner diameter of the fitting portion of the substrate | • giving a centering location process when the substrate is a cut tube<br>• roll correction |
| (4) | Roundness of rotation center of a flange and the outer diameter | • cutting |

TABLE 1-continued

| No. | Factors forming total deflection | Specific means for improving accuracy |
|---|---|---|
| (5) | Roundness of the rotation center of the flange and the outer diameter of the fitting portion | • one chuck cutting of the rotation center and the outer diameter portion |
| (6) | Difference between the inner diameter of the fitting portion of the substrate and the outer diameter of the fitting portion of the flange | • set tolerance between the inner diameter of the substrate and the outer diameter of the flange in close fit |

In order to improve the deflection, the number of processes for working parts increases as shown in Table 1. Further, though not shown in the table, inspection processes and inspection frequency are increasing so as to increase the producing cost thereof. On the contrary, if the cost is restrained, some of the working means as shown above have to be omitted, so that the total deflection deteriorates in comparison with the case where they are not omitted. Consequently, enhanced images cannot be obtained in an image forming apparatus. Particularly, the concentricity has a limit in the improvement of accuracy because the respective outer circumferential portions of flanges are fitted into the inner circumferential portions of the end portions of a drum as mentioned above. Accordingly, the concentricity has not been satisfactory. Particularly in the case of a welded tube such as an electro-unite tube, a flange cannot be fitted as its inner circumferential portion has not been treated, and its welded portion is structurally different from its not-welded portion. It is therefore difficult to improve the accuracy to finish an inner circumferential portion of a substrate, and the accuracy of size is not enough when the flange is attached thereto, so that the obtained tube has a problem as a photosensitive body with a flange.

Moreover, as shown in the item (6) of Table 1, in a photosensitive body with a flange, the tolerance center of the flange outer diameter and the substrate inner diameter in a fitting portion is generally established into close fit regardless to the existence of adhesive in order to restrain deflection. Therefore, once flanging is performed, both the flange and the substrate are transformed by close fit, so that it is difficult to use them repeatedly. Particularly from the point of view of reclamation of used parts, which is cared for socially recently, it is a fact that such a photosensitive drum with a flange is not preferred.

There is another problem that even if a photosensitive layer is formed on such a substrate, and used as a photosensitive body in an image forming apparatus such as a copying machine, a printer, or the like, and if the photosensitive body having no days is collected on the market, it is difficult to separate the photosensitive layer without damaging the substrate.

On the other hand, a contact electrification system in which an electrified member is made to contact with a body to be electrified to thereby electrify the body is put to practical use recently. In such a contact electrification system, an electrified member to which a voltage (for example, about a 1 to 2 kV DC voltage, a superposed voltage of an AC voltage and an DC voltage, or the like) is applied is made to contact with a body to be electrified by predetermined pressure so as to electrify the body to be electrified to a predetermined potential. However, when such a contact electrification apparatus is adopted in an image forming apparatus where an electrostatic latent image is formed on a photosensitive body, which is a body to be electrified, by line scanning, an electrified member of the contact electrification apparatus contacts with the photosensitive body having flanges, so that an oscillating electric field generated therebetween makes them oscillate. Consequently, there is a problem that oscillating noises are apt to be generated. In a process for cleaning the photosensitive body, in accordance with material of a blade or conditions of use, there is another problem that oscillating noises are generated between the blade and the photosensitive body having flanges when the blade slides in contact with the photosensitive body.

These oscillating noises generated thus have a tendency to more increase as a substrate is thinner. Particularly in an aluminum metal (including an aluminum alloy) having a low rigidity, this tendency appears conspicuously.

Therefore, according to one of methods to prevent oscillating noises from being generated, which has been adopted conventionally, a filler formed from metal material, viscous material, and composites thereof is charged into a photosensitive body. Without charging such a filler, the thickness of a substrate for a photosensitive body had to be increased to increase the rigidity of the substrate itself. In either case, not only the weight has been increased, but also the cost has been increased inevitably.

SUMMARY OF THE INVENTION

It is an object of the present invention to provide a method for driving a photosensitive body in which total deflection is improved, and oscillating noises are not generated. It is another object of the invention to provide a photosensitive body which is superior in size accuracy, hence improved in total deflection, and has no oscillating noises generated in use of a contact electrification system or a cleaning blade.

In order to accomplish the object of the present invention, a method for driving a photosensitive drum according to the present invention includes the step of: driving the photosensitive drum with providing a plurality of rotation supporting member at a base position which is a surface of a photosensitive body, the photosensitive drum comprising a worked electro-unite tube which is formed by at least one of drawing and extruding a electro-unite made from at least one of a metal strip and a metal plate being cylindrically rolled up.

In order to accomplish the another object of the present invention, a photosensitive drum according to the present invention includes: a substrate comprising a worked electro-unite tube which is formed by at least one of drawing and extruding a electro-unite made from at least one of a metal strip and a metal plate being cylindrically rolled up; and a photosensitive layer formed on the substrate; wherein the photosensitive material is rotated based on an outer circumference of the substrate.

According to the present invention, supporting and driving are based on an outer circumferential portion of a substrate of a photosensitive body, so that total deflection can be improved, and oscillating noises can be prevented from being generated even if a contact member is used to drive.

DETAILED DESCRIPTION OF THE INVENTION

The present invention will be described below in detail referring to the accompanying drawings.

Figure 1:
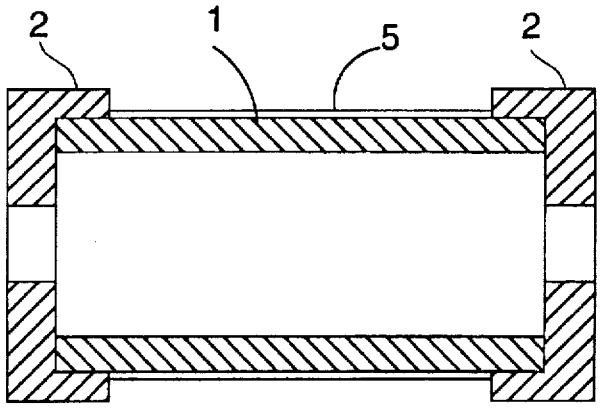
FIG. 1 is a sectional view of an embodiment of the photosensitive body with flanges according to the present invention.
Figure 2A:
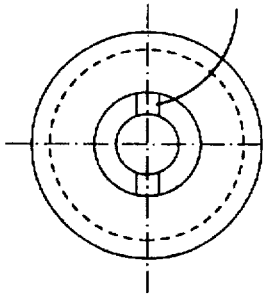
FIG. 2A is a side view of a substrate of another embodiment of the photosensitive body with flanges according to the present invention.
Figure 2B:
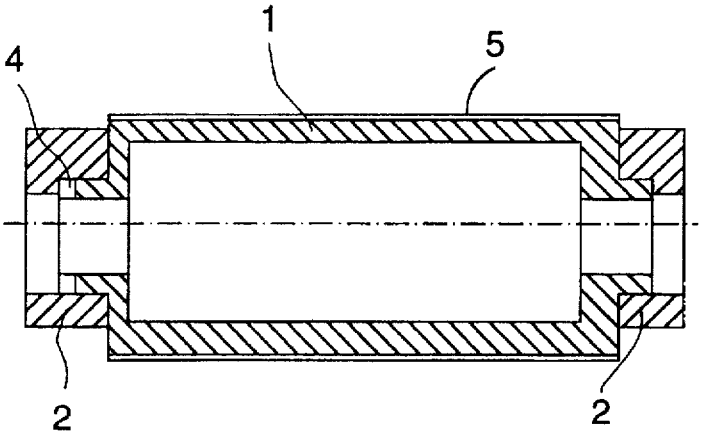
FIG. 2B is a sectional view of the photosensitive body with flanges according to the present invention.

FIG. 1 is a sectional view of an embodiment of a photosensitive body with flanges according to the present invention. A photosensitive layer 5 is formed on the surface of a substrate 1. Flanges 2, 2 are attached to the opposite ends thereof so that inner circumferential portions of the flanges are fitted to the outer circumferential portions of the end portions of the substrate, respectively. FIG. 2A is a side view of a substrate of another embodiment of the photosensitive body with flanges according to the present invention. FIG. 2B is a sectional view of the photosensitive body with flanges according to the present invention. In FIGS. 2A and 2B, a drawing process is given to the opposite end portions of a substrate 1 provided with a photosensitive layer 5 on the surface, and a slit 4 for fixing a driving flange is formed in one of the end portions. Flanges 2, 2 are attached so that the outer diameter portions of the opposite end portions which have been subjected to the drawing process are fitted into the inner diameter portions of the flanges respectively. Although a drawing process is given to the opposite end portions of the substrate in the case of FIG. 2, the drawing process may be given to only one of the end portions of the substrate.

Preferable examples of materials of the substrate used in the present invention are, for example, stainless steel, brass, and so on.

Preferably, in the present invention, an electro-unite tube is used as the substrate. The electro-unite tube is manufactured by rolling up a metal strip or a metal plate and welding a joint portion thereof, preferably by TIG-welding, into a cylindrical shape. Extended in accordance with necessity, the manufactured tube is corrected, cut and further corrected in accordance with necessity, so as to be used as a substrate for a photosensitive body.

Further, preferably, in the substrate in the present invention, the size accuracy of straightness and roundness of the surface shape is within the range of from 0.080 to 0.002 mm, and the surface roughness is within the range of from 3.0 to 0.2 μm as Rmax.

Next, when a substrate used in the present invention is an electro-unite tube, the method of manufacturing the substrate will be described as follows.

Figure 3:
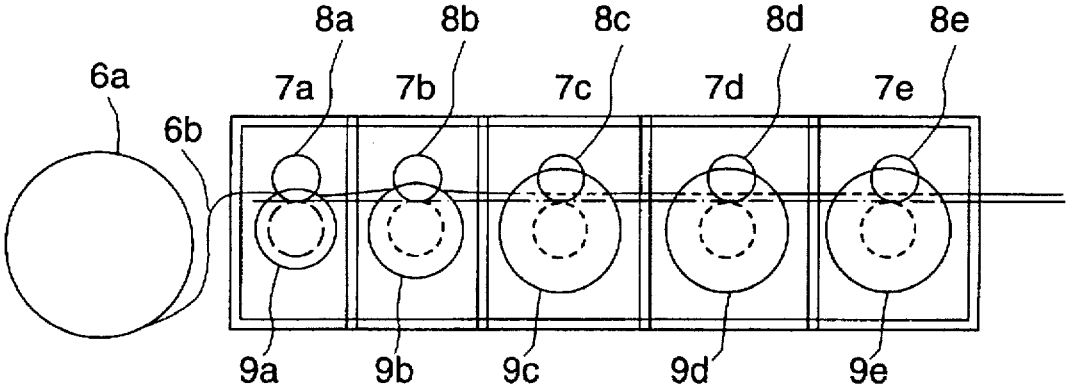
FIG. 3 is a type diagram for explaining processes to manufacture a tube out of a metal strip.
Figure 4:
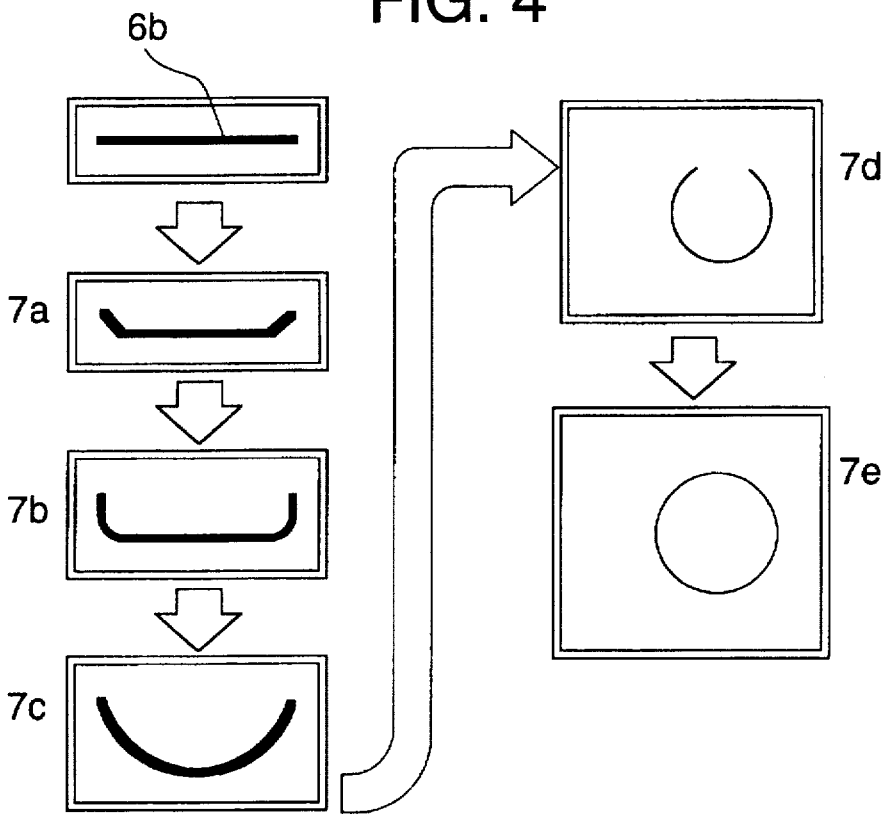
FIG. 4 is an explanatory diagram illustrating the states where the metal strip is transformed in the respective processes in FIG. 3.

FIG. 3 is a typical diagram for explaining processes to manufacture a tube out of a metal strip, and FIG. 4 is a diagram illustrating the state of the metal strip transformed in the respective processes in FIG. 3.

Figure 5:
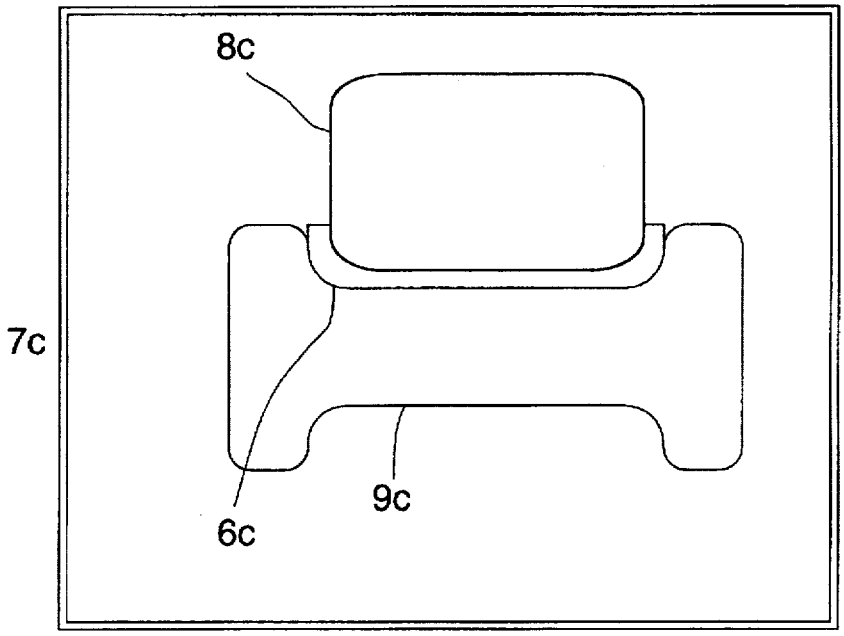
FIG. 5 is an explanatory diagram of the state of transformation in the third process in FIG. 3.

As shown in FIG. 3, a metal strip 6*a* wound into a coil is extracted from the coil (6*b*), and gradually transformed into a tube through a bending process 1 (7*a*) where the metal strip 6*a* is held between a bending upper roller 8*a* and a lower roller 9*a*, a bending process 2 (7*b*) where the metal strip 6*a* is held between a bending upper roller 8*b* and a lower roller 9*b*, a bending process 3 (7*c*) where the metal strip 6*a* is held between a bending upper roller 8*c* and a lower roller 9*c*, a bending process 4 (7*d*) where the metal strip 6*a* is held between a bending upper roller 8*d* and a lower roller 9*d*, and a bending process 5 (7*e*) where the metal strip 6*a* is held between a bending upper roller 8*e* and a lower roller 9*e*. In FIG. 5, which explains the transformation state in the third process in FIG. 3, a metal strip 6*c* is held and transformed between the bending upper roller 8*c* and the lower roller 9*c*.

The curve R of the end portions of the bending upper rollers 8 increases gradually in the direction of the processes going (the bending process 1 (7*a*)→the bending process 2 (7*b*)→the bending process 3 (7*c*)→the bending process 4 (7*d*)→the bending process 5 (7*e*)). At the same time, the curve R of the end portions of the bending lower rollers 9 increases gradually in the direction of the processes going (the bending process 1 (7*a*)→the bending process 2 (7*b*) →the bending process 3 (7*c*)→the bending process 4 (7*d*) →the bending process 5 (7*e*)). The metal strip 6 subjected to such processes is transformed and finally formed into a tube through the respective processes as shown in FIG. 4.

Figure 6:
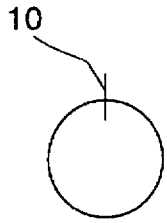
FIG. 6 is an explanatory diagram illustrating the state where a shim is inserted to tube material immediately before welding given thereto in an embodiment of the present invention.

A joint portion of the tube thus formed is TIG-welded. That is, arc is generated between a tungsten electrode and a not-welded member, so as to melt a member to be welded, and give welding thereto. Preferably in this case, as shown in FIG. 6, a shim 10 is inserted immediately before the welding, and the welding is performed in inactive gas such as argon gas while a constant gap is kept. The shim is inserted to keep a constant gap so as to prevent beats caused by welding from occurring, and the welding is performed in argon gas so as to prevent materials from being oxidized. In addition, although the outer circumference is subjected to the various following processes, an inner circumference of the substrate may have a unworked welding trace.

Extending processes are given to the electro-unite tube thus manufactured in accordance with necessity. FIGS. 7A to 7D are an explanatory diagram showing the extending processes.

Figure 7A:
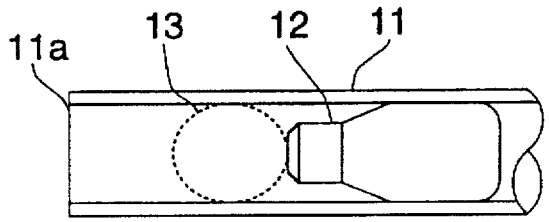
FIGS. 7A to 7D are explanatory diagrams illustrating processes to extend a tube.
Figure 7B:
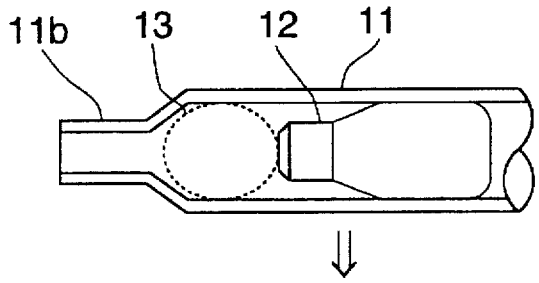
Figure 7C:
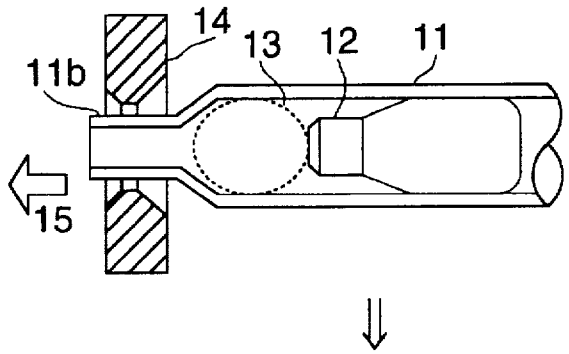
Figure 7D:
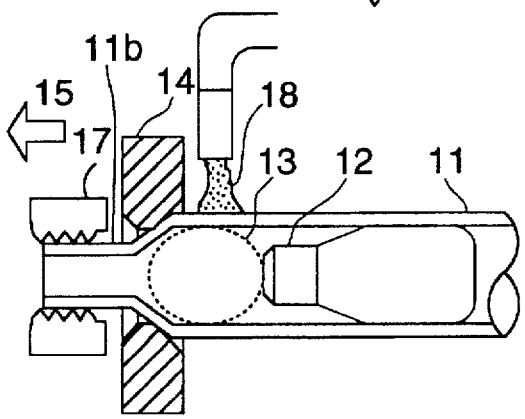
Figure 8:
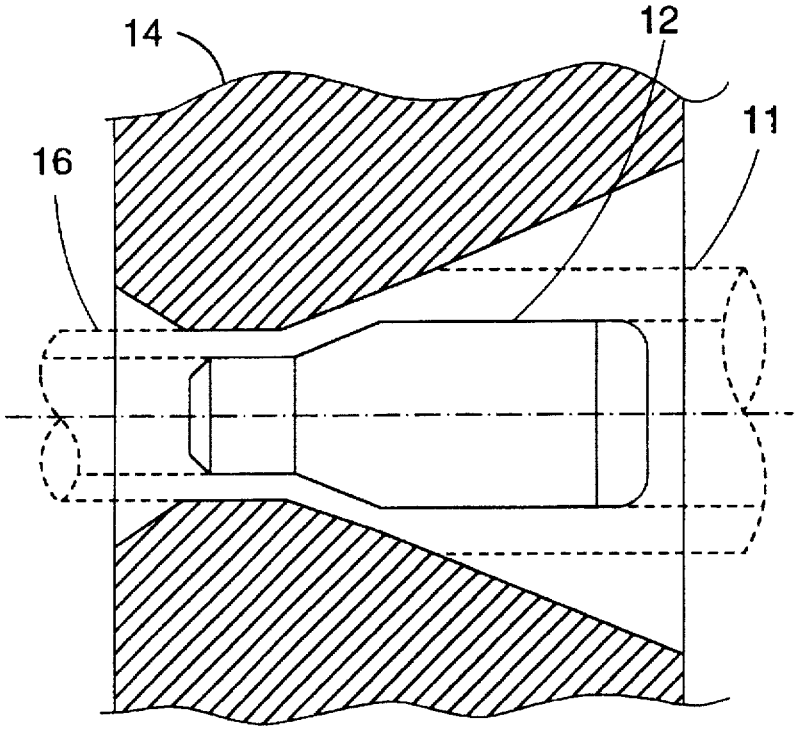
FIG. 8 is an expanded sectional view of a main portion in the processes to extend a tube.

A plug 12 is inserted to an open top end portion 11*a* of a tube 11 formed as mentioned above, and grease 13 is further charged thereto (see FIG. 7A). Thereafter, the open top end portion 11*a* is squashed by a general press (hereinafter this working is referred to as "mouth forming") (see FIG. 7D). The diameter of the mouth-formed top end portion 11*b* is ϕ3 mm to ϕ5 mm. This top end portion 11*b* is put through a hole portion of a dice 14 (FIG. 7C), and the top end portion 11*b* is drawn in an arrow direction 15 while gripped by a gripper 17 and showered with lubricating oil 18 (the same as the above-mentioned grease 13) (FIG. 7D). Then the dice 14 contacts with the portion where the diameter changes gradually between the mouth-formed top end portion 11*b* and the rest not-mouth-formed portion, so that a resistance occurs when the tube 11 is drawn. If the tube 11 is further drawn against this resistance, the tube 11 is drawn as the plug 12 is apparently stopping through the tube 11 relatively to the dice 14 as shown in FIG. 8. The drawn portion of the tube is hence changed in diameter and in thickness.

Super hard materials may be used for the dice and the plug, and that which is ion-plated with TiN in the portion sliding on the tube may be used preferably. Varying in accordance with required quality, the rate of forming a tube is generally within a range of from 2 to 30 m/min.

Figure 9A:
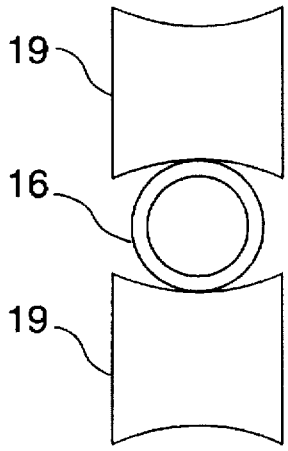
FIG. 9A is a sectional view of a diagram for explaining a correction process.
Figure 9B:
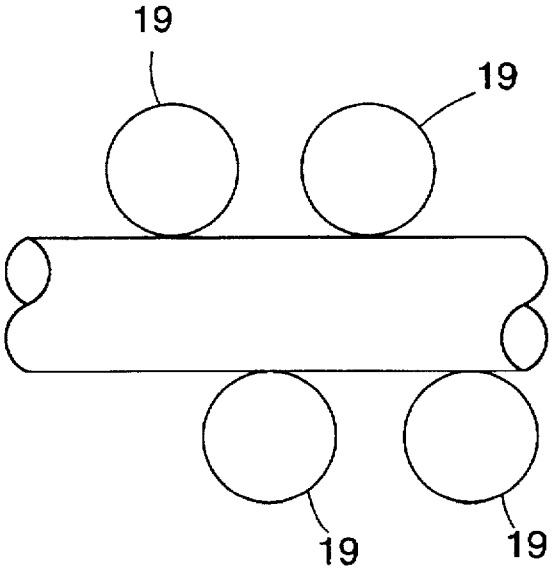
FIG. 9B is a side view of the diagram for explaining the correction process.

The tube formed through the extending processes is corrected in order to have a required size accuracy, if desired. FIG. 9A is a sectional view of a diagram for explaining a correction process. FIG. 9B is a side view of the diagram for explaining the correction process. In the drawings, a tube (subject to be worked) 16 which has been subjected to the extending processes is held between correcting rollers 19 from the upper and lower so as to be subjected to roller correction. During the roller correction, illuminating kerosine or the like is used as lubricant, which is preferable to use because it has a function to cleanse the grease used in the extending processes.

In addition, this correction process can be subjected to not only the long tube but also a short tube which is a final product without any problems The tube is finally cut into the length of an end item. The tube (11 or 16) manufactured thus may be subjected to various surface finishing in accordance with surface properties required as a substrate for a photosensitive body. Examples of the surface finishing are grinding or mechanical polishing, honing, blasting, electrolytic polishing, annealing by a high-frequency current, and so on. Other working such as lapping, buffing, brushing and so on may be performed.

Figure 10A:
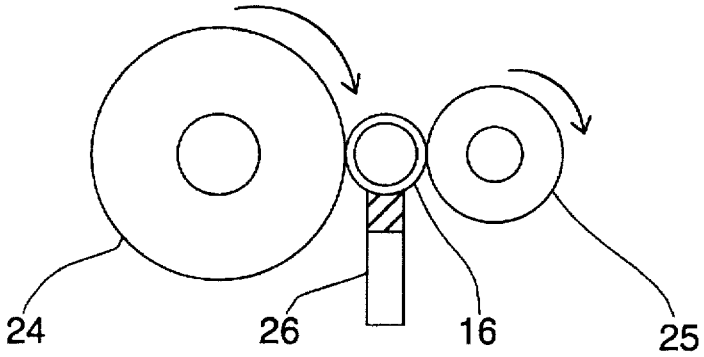
FIG. 10A is a side view of a schematic structural diagram of a centerless grinder.
Figure 10B:
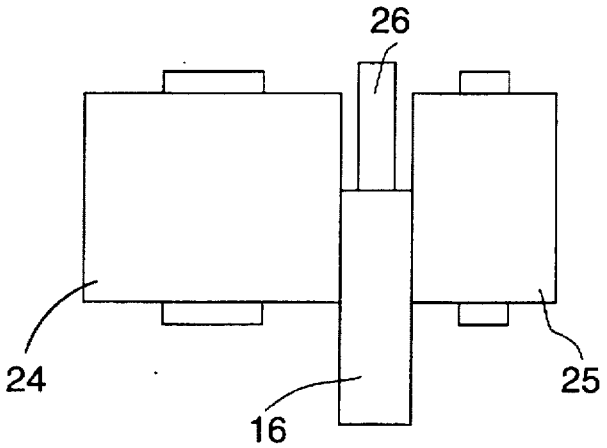
FIG. 10B is a plan view of the schematic structural diagram of a centerless grinder.

When grinding or mechanical polishing is given as surface finishing, for example, a centerless grinder as shown in FIGS. 10A and 10B is used. FIG. 10A is a side view of a schematic structural diagram of a centerless grinder. FIG. 10B is a plan view of the schematic structural diagram of a centerless grinder. In this case, the tube (subject to be worked) 16 is fed onto a blade 26, passed between a grind stone 24 and a regulating wheel 25 which are adjusted to have a proper distance, and polished or ground into required size and required surface roughness. Grind oil used in this case is varied in accordance with the surface performance of a required substrate. Water-soluble grind oil or illuminating kerosine is generally used. Preferably the grind stone 24 used for grinding or polishing is of material which is soft to a some extent, and further it is preferable that the grain size can be selected desirably from rough size to fine size.

Figure 11:
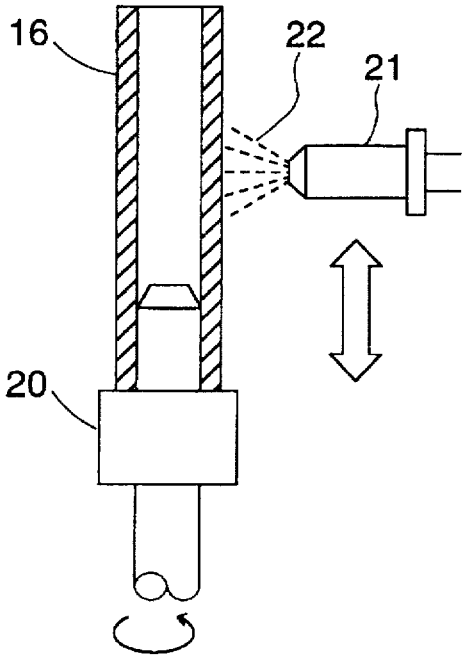
FIG. 11 is an explanatory diagram for explaining a honing process.

When honing is given as surface finishing, for example, an apparatus shown in FIG. 11 may be used therefor. After the tube (subjected to be worked) 16 is chucked by a rotation chuck 20, the chuck is rotated at 1,000 rpm, and suspension 22 of water and abrasive (such as alumina granular fine powder) is introduced into a honing gun 21, and sprayed, for example, with the air of 3 kg/cm$^2$. At this time, the rotation of the rotation chuck 20 and the vertical feed of the honing gun 21 are synchronized with each other. A substrate of surface roughness Rmax 3.0 to 0.2 μm is completed thus.

Figure 12:
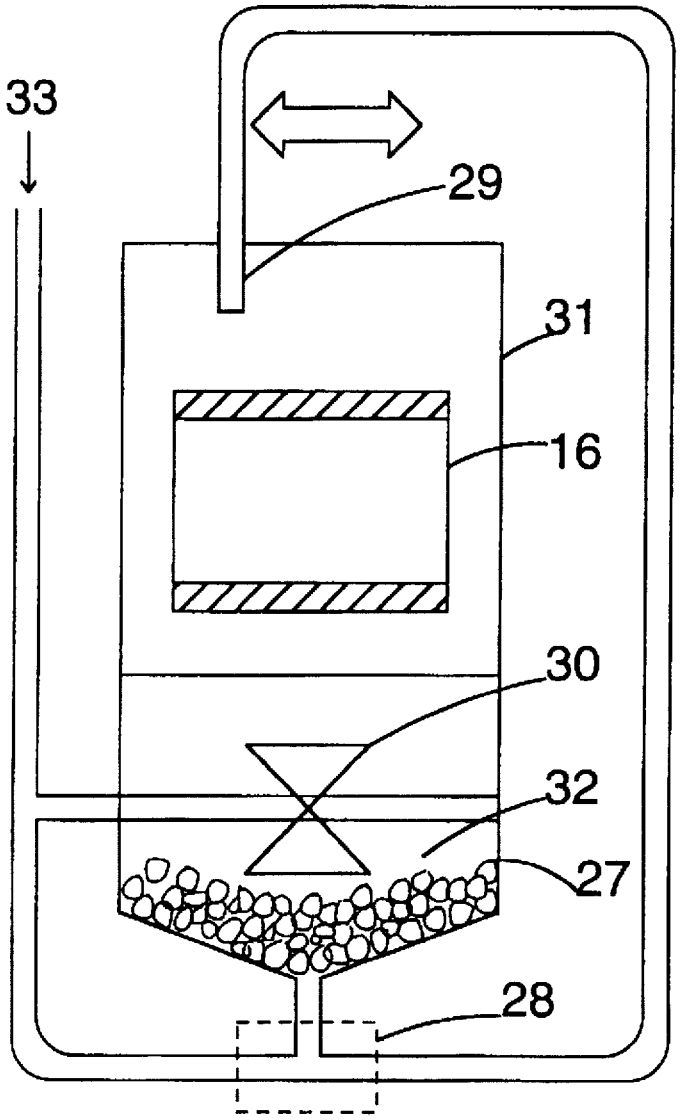
FIG. 12 is a schematic structural diagram of a dry air-acceleration blasting machine in which compressed air is fed by pressure.

Blasting is performed in a well-known manner, such as centrifugal projection, air acceleration, belt projection, water injection, or the like. FIG. 12 is a schematic structural diagram of a dry air-acceleration blasting apparatus where compressed air is fed by pressure. A projected material 32 in a pressure tank 27 is accelerated in a mixing chamber 28 by compressed air 33, introduced into a projection room 31, and sprayed from a nozzle 29. In this case, the balance of the pressure in the pressure tank 27 and that of the compressed air 33 is maintained so that a poppet valve 30 is closed. If the projected material 32 in the pressure tank 27 disappears, the poppet valve 30 is opened by returning the pressure in the pressure tank 27 to the atmospheric pressure to collect the projected material 32 into the pressure tank 27 again.

Figure 13A:
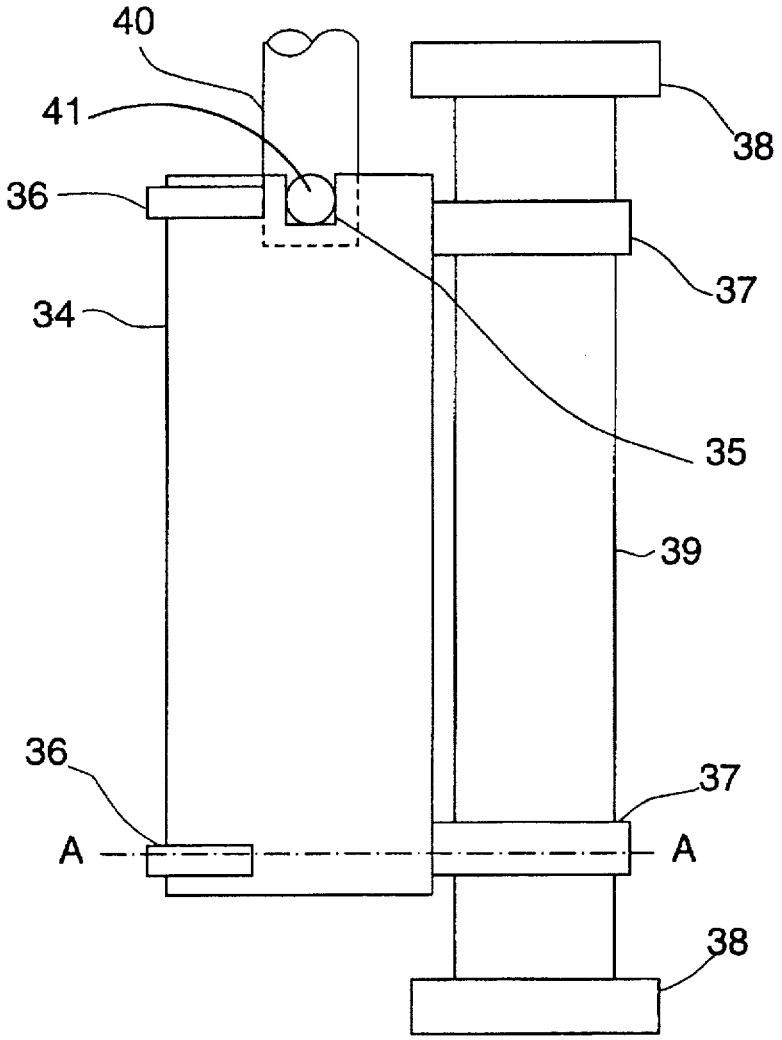
FIG. 13A is a plan view of an explanatory diagram showing a case where a drum-like photosensitive body is driven by directly joining a driving shaft to the photo sensitive body.
Figure 13B:
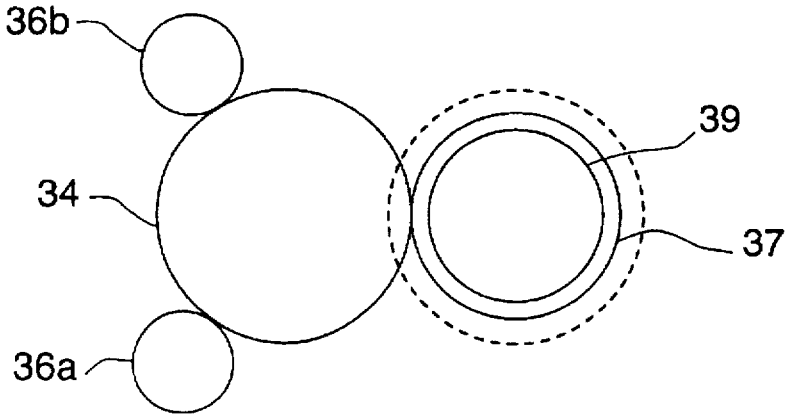
FIG. 13B is a sectional view taken on line A—A of FIG. 13A.

Next, a representative method for driving a photosensitive body according to the present invention will be described. According to a representative driving method of the present invention, two support rolls and two tracking rolls of a developing apparatus are respectively contacted with the neighborhoods of the opposite end portions of a drum-like photosensitive body provided with a photosensitive layer on a substrate so as to support and drive the photosensitive body. FIG. 13A is a plan view of an explanatory diagram showing a case where a drum-like photosensitive body is driven by directly joining a driving shaft to the photo sensitive body. FIG. 13B is a sectional view taken on line A—A of FIG. 13A. In the drawings, the reference numeral 34 represents a photosensitive drum having a slit 35 formed in its one end. The photosensitive drum is supported at its opposite ends by a pair of support rolls and a pair of tracking rolls. That is, tracking rolls 37 provided coaxially with a developing roll 39 supported at its opposite ends by support bearings 38 and 38 are made to contact with the neighborhoods of the opposite ends of the photosensitive drum, and a pair of support rolls 36*a* and 36*b* are made contact with the neighborhoods of the opposite ends of the photosensitive drum, so as to support the photosensitive drum. Here, the diameter of the tracking roll is larger than that of the developing roll. A drive transmission pin 41 attached to a driving shaft 40 is fitted into the slit 35 of the photosensitive drum so that the photosensitive drum is rotated by the drive and rotation of the driving shaft 40. Although only one slit is illustrated in FIG. 13A, two or more slits may be provided. The photosensitive drum is driven by rotating the driving shaft 40.

Figure 14:
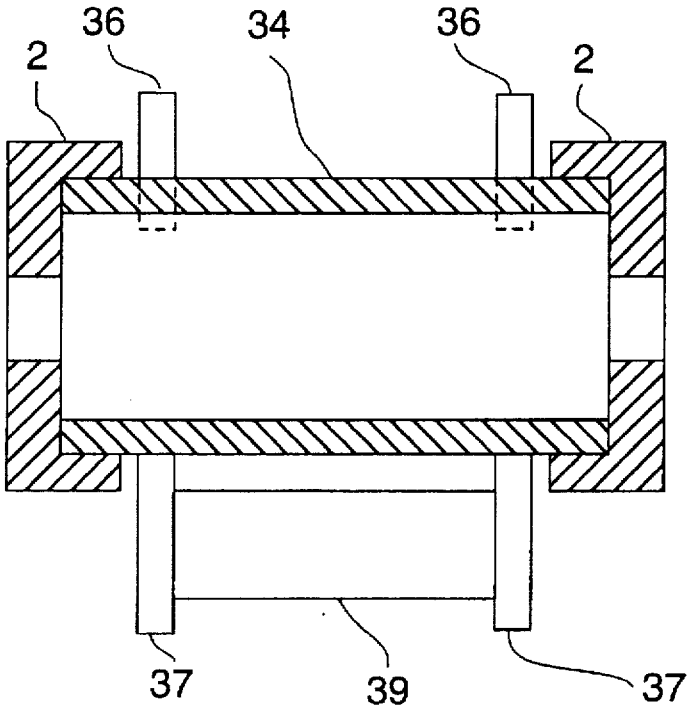
FIG. 14 is an explanatory diagram showing the case where a photosensitive body with flanges according to the present invention is driven.
Figure 15:
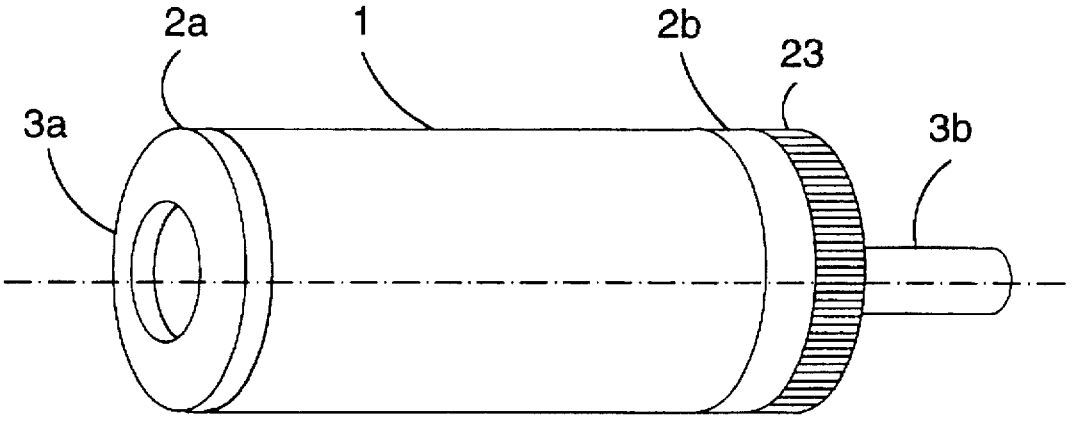
FIG. 15 is a perspective view of a conventional photosensitive body with flanges.

Although the photosensitive drum without flanges is used in FIG. 13, the photosensitive drum provided with a driving flange as shown in FIG. 1 may be used so to be supported in the same manner as in the case of FIG. 13, and driven by the driving flange. FIG. 14 shows the case in which a photosensitive drum 34 provided with flanges 2 at its opposite ends in the same manner as in FIG. 1 is supported by support rolls 36 and tracking rolls 37 attached coaxially with a developing roll 39. One of the flanges is a driving flange, which can be driven by a not-shown and well-known suitable device, apparatus or the like.

In addition, driving the photosensitive drum based on the outer circumference of the photo sensitive body, it is capable of rotationally driving the drum without the strict formation of the tolerance of the photosensitive drum itself. The electrification member such as a electrification roll may be used as the supporting rolls used for positioning and assisting the rotation of the photosensitive body in the above description.

The present invention will be described below with respect to specific examples.

EXAMPLE 1

In this example, a strip of stainless steel (SUS 304) which was 65 mm wide and 0.45 mm thick was prepared. Since a burr would be generated in a strip on manufacture, the strip was set so that its burr side was on the side of the inner diameter in order to prevent a projection from appearing in the outer diameter portion in this example, and the strip was transformed into a tube by the apparatus shown in FIG. 3. Next, as shown in FIG. 6, a shim was inserted immediately before welding, and arc was generated between a tungsten electrode and a not-welded member in argon gas as a constant gap was kept, so as to melt a member to be welded, and give welding thereto. Thus manufactured tube has an outer diameter of $\phi$21 mm and a thickness of 0.45 mm which was equal to the thickness of its original plate material.

Next, the manufactured tube was extended as shown in FIGS. 7A to 7D. Polybutene (HV-15, made by Nippon Oil Co., Ltd.) was used as grease. Super hard material in which a portion sliding on the tube was TiN ion-plated was used as a dice and a plug. As a result, manufactured was a tube of having a diameter of $\phi$19.8 mm and a thickness of 0.4 mm in which few scratches were generated at a pipe manufacturing rate of 2 m/min. Further, the tube was corrected by a correcting apparatus shown in FIG. 9 using illuminating kerosine as lubricant. After that, the tube was cut into the length of an end item.

Table 2 shows the result of inspection upon the size accuracy and the surface roughness of the tube manufactured thus.

TABLE 2

| Measurement Item | Measurement Result |
|---|---|
| Verticality (μm) | 56 |
| Roundness (μm) | 32 |
| Surface Roughness (Rmax) (μm) | 1.9 |

The above-mentioned tube was used as a substrate for a photosensitive body, and thereon 8-nylon resin (Luckamide, made by Dai Nippon Ink & Chemicals Inc.) was coated with a methanol/butanol mixed solution by dip coating, so as to form an under coat layer of film having a thickness of 1.0 μm.

On the other hand, one part (hereinafter "part" means weight part) of polyvinyl butyral resin (BM-1, made by Sekisui Chemical Co., Ltd.) was dissolved in 19 parts of cyclohexanone, and 8 parts of dibromanthoanthrone pigment (C.I. Pigment Red 168) and 0.02 part of trifluorochloroacetate were added to the obtained solution. Next, dispersing was performed by a sand mill with glass beads having a diameter of 1 mm as carrier media. Cyclohexanone was added to the dispersed solution obtained, so as to prepare coating solution of solids concentration about 10%. This coating solution was applied onto the under coat layer formed as mention above by a ring coating machine, heated and dried for 10 minutes at 100° C., so as to form a charge generation layer of film having a thickness of 0.8 μm.

Next, 4 parts of N,N'-diphenyl-N,N'-bis (3-methylphenyl) benzine and 6 parts of polycarbonate resin were dissolved in 36 parts of monochlorobenzene. The thus obtained solution was applied onto the above-mentioned charge generation layer by dip coating, dried for 60 minutes at 115° C., so as to form a charge transmission layer of film having a thickness of 18 μm to thereby manufacture an OPC (Organic Photosensitive Constitution) drum.

The inner circumferential portions of flanges were fitted onto the outer circumferential portions of end portions of this OPC drum as shown in FIG. 1, so as to obtain a photosensitive drum with flanges. This photosensitive drum with flanges was mounted on a copying machine, and evaluated upon images, so that superior images could be obtained.

The distance between this photosensitive drum with flanges and a developing roll was surveyed at 8 points in the circumferential direction of the photosensitive body and 3 points in the axial direction. Consequently, the distance (mm) between the photosensitive drum and the developing roll was average=0.195 and $\sigma$=0.012.

EXAMPLE 2

30 parts of superfine particulate titanium oxide (STT30D, made by Titan Kogyo K.K.) having a grain size of 0.09 μm was dispersed by a sand mill in a solution in which 100 parts of toluene solution of 50% tributoxy zirconium acetylacetonate (ZC540, made by Matumoto Kosho Co., Ltd.), 10 parts of $\gamma$-aminopropyl triethoxysilane (A1199, made by Nippon Unicar Co., Ltd.) and 130 parts of n-butanol were mixed.

On the other hand, the dispersed solution was applied onto the surface of a substrate obtained in the same manner as in Example 1 by a ring coating machine, and heated at 140° C. for 10 minutes, so as to form a hardened under coat layer of film having a thickness of 2.0 μm comprised of an inorganic hardened film formed by the reaction of zirconium compound and silane compound.

Next, hydroxy gallium phthalocyanine pigment (refer to Unexamined Japanese Patent Publication No. Hei-5-263007) was mixed to cyclohexanone solution containing 2% polyvinyl butyral resin (BM-S, made by Sekisui Chemical Co., Ltd.) so that the PB ratio was 2:1, the mixture being dispersed by a sand mill for 3 hours. The dispersed solution was diluted with n-butyl acetate, applied onto the under coat layer, and dried for 10 minutes at 100° C., so as to form a charge generation layer of film having a thickness of 0.05 μm. A charge transmission layer was formed thereon in the same manner as in Example 1, so as to manufacture an OPC drum.

Flanges were fitted to this OPC drum in the same manner as in Example 1, and the OPC drum was mounted on a laser printer using a contact electrifier, and evaluated upon images. Consequently, superior images could be obtained.

Oscillating noises caused by an oscillating electric field was also evaluated at the same time. The evaluation was performed in a laser printer altered so that a voltage can be turned on/off manually. The evaluation was performed by using a sound pressure meter installed at a position 30 cm on this side of and 40 cm above the laser printer. The frequency evaluated was twice as high as the frequency of a power supply. Table 3 shows the result of the evaluation.

TABLE 3

| On/Off of Power of Contact Electrifier | Sound Pressure | Feeling of Sound |
|---|---|---|
| Off | 48.5 dB | Calm and comfortable sound. |
| On | 50.2 dB | Insignificant level hardly different from the above state. |

EXAMPLE 3

The tube of Example 1 was ground or mechanically polished by a centerless grinder shown in FIG. 10. Illuminating kerosine was used as grind oil. CBM abrasive grains were used as grind stone, giving in-field finishing at the feed speed 5 m/min.

Table 4 shows the result of inspection upon the size accuracy and the surface roughness of the tube manufactured thus.

TABLE 4

| Measurement Item | Measurement Result |
|---|---|
| Verticality (μm) | 9 |
| Roundness (μm) | 6 |
| Surface Roughness (Rmax) (μm) | 0.2 |

The tube thus obtained was used as a substrate for a photosensitive body, and a photosensitive layer was formed thereon in the same manner as in Example 1. Flanges were fitted thereto in the same manner as in Example 1, mounted on a copying machine, and evaluated upon images. Consequently superior images could be obtained.

EXAMPLE 4

Blasting was given to the tube of Example 1. The blasting was performed by use of an apparatus shown in FIG. 12, and it was a dry air-acceleration blasting process where compressed air was fed by pressure. Steel grits (Hc64) having an average grain size of 0.32 mm were used as projected material, and given pressure of 3 kg/cm$^2$, so that the quantity of projection of 5 kg/min could be obtained. Table 5 shows the result of inspection upon the size accuracy and the surface roughness of the tube manufactured thus.

TABLE 5

| Measurement Item | Measurement Result |
|---|---|
| Verticality (μm) | 55 |
| Roundness (μm) | 47 |
| Surface Roughness (Rmax) (μm) | 2.4 |

A photosensitive layer was formed on the substrate obtained thus in the same manner as in Example 2. Flanges were fitted thereto in the same manner as in Example 1. The photosensitive drum obtained was mounted on a laser printer, and evaluated upon images. Consequently, superior images could be obtained.

EXAMPLE 5

Honing was given to the tube of Example 1. The honing was performed by using an apparatus shown in FIG. 11. The tube was chucked by the rotation chuck, and the chuck was rotated at 1,000 rpm. Water suspension of alumina granular powder was introduced into a honing gun as abrasive, and sprayed with the air of 3 kg/cm$^2$. At that time, the rotation of the rotation chuck and the vertical feed of the honing gun were synchronized with each other.

Table 6 shows the result of inspection upon the size accuracy and the surface roughness of the tube manufactured thus.

TABLE 6

| Measurement Item | Measurement Result |
|---|---|
| Verticality (μm) | 54 |
| Roundness (μm) | 42 |
| Surface Roughness (Rmax) (μm) | 1.8 |

The tube obtained thus was used as a substrate for a photosensitive body, and a photosensitive layer was formed thereon in the same manner as in Example 2. Flanges were fitted thereto in the same manner as in Example 1. The photosensitive drum obtained was mounted on a laser printer, and evaluated upon images. Consequently, superior images could be obtained.

EXAMPLE 6

The tube of Example 1 was subjected to electrolytic polishing where the tube was contacted with solution soaking the surface of the substrate so as to erode the surface, so as to obtain required surface properties and surface roughness of the substrate. Since the electrolytic polishing itself has been a well-known technique, its detailed description is omitted. Mixed solution of phosphoric acid and chromic acid (300 g chromic acid to 1,000 ml phosphoric acid) was prepared as an elecrolyticsolution, and heated to 130° C. The substance to be worked was immersed in this electrolytic solution for 5 or 6 seconds.

Table 7 shows the result of inspection upon the size accuracy and the surface roughness of the tube manufactured thus.

TABLE 7

| Measurement Item | Measurement Result |
|---|---|
| Verticality (μm) | 44 |
| Roundness (μm) | 36 |
| Surface Roughness (Rmax) (μm) | 1.2 |

The tube obtained thus was used as a substrate for a photosensitive body, and a photosensitive layer was formed thereon in the same manner as in Example 1. Flanges were fitted thereto in the same manner as in Example 1, so as to manufacture a photosensitive drum. This was mounted on a copying machine, and evaluated upon images. Consequently, superior images could be obtained.

EXAMPLE 7

Annealing with a high-frequency current was given to the tube obtained by a tube forming method in the same manner as in Example 3. The tube was passed at 1.5 m/min through a ring where a high-frequency current was flowing, and cooled gradually after heated to 1,050° to 1,100° C.

Table 8 shows the result of inspection upon the size accuracy and the surface roughness of the tube manufactured thus. For reference, Table 9 shows the hardnesses of the tube before and after annealing after extending. The measured portion was a portion adjacent to a welded portion.

TABLE 8

| Measurement Item | Measurement Result |
|---|---|
| Verticality (μm) | 10 |
| Roundness (μm) | 5 |
| Surface Roundness (Rmax) (μm) | 0.2 |

TABLE 9

| Hv | Measurement Result |
|---|---|
| Before Annealing | 301 |
| After Annealing | 177 |

Two tubes, one after annealing in the above conditions, and the other before annealing, were prepared as a substrate for a photosensitive body manufactured in Example 1. Each was chucked by a rotation chuck of a honing apparatus, and rotated at 1,000 rpm. Suspension of water and abrasive (alumina granular powder) was introduced into a honing gun, and sprayed with the air of 2 kg/cm$^2$. At that time, the rotation of the rotation chuck and the vertical feed of the honing gun were synchronized with each other. Table 10 shows the result of measurement of surface roughness of the substrates obtained thus.

In addition, each tube was used as a substrate for a photosensitive body, and a photosensitive layer was formed thereon in the same manner as in Example 2. Flanges were fitted thereto in the same manner as in Example 1. The photosensitive drum obtained was mounted on a laser printer, and evaluated upon images. Table 10 also shows the result.

TABLE 10

| Measurement Item | High Frequency Annealing | Measurement Result | Image Evaluation Result |
|---|---|---|---|
| Surface roughness (Rmax) (μm) | Yes | 1.8 | Superior Image |
| | No | 1.7 (Unevenness of honing could be confirmed in a welded portion) | Image where unevenness of density could be seen |

EXAMPLE 8

The photosensitive drum with flanges in Example 1 was used to copy about 4,000 sheets. A charge transmission layer was worn into 16 μm, and deteriorated in electrization. There was not any other damage. This used drum was immersed in monochloro-benzene put in a vessel, and swung up and down to dissolve the charge transmission layer. The drum was cleansed roughly in a first tank, and immersed in monochlorobenzene in the next vessel again, so that the charge transmission layer was dissolved perfectly.

After the drum was extracted and the surface thereof was dried, it was confirmed that there was no unevenness in the surface of its charge generation layer. Thereafter, a charge transmission layer was formed by coating again. An OPC drum reclaimed thus could be used in the same manner as a new product.

EXAMPLE 9

A substrate for a photosensitive body was prepared in the same processes as in Example 1. Drawing was given to the opposite end portions thereof as shown in FIG. 2. Thereafter, a slit was formed in one of the end portions by a laser beam machine as shown in the same drawing FIG. 2. The diameter of a not-drawn portion was ϕ19.8 mm, and the thickness was 0.4 mm, the same as those before the drawing. On the other hand, the diameter of the drawn portion was ϕ10 mm, and the width of the slit was 3 mm. A photosensitive layer was formed on the surface of this substrate in the same manner as in Example 1. Flanges were fitted thereto as shown in FIG. 2, that is, inner circumferential portions of flanges were fitted to the outer circumferential portions of the end portions of the substrate, so as to manufacture a photosensitive drum with flanges. This was mounted on a copying machine, and evaluated upon images. Consequently, superior images could be obtained in the same manner as in Example 1.

Comparative Example 1

In order to make a comparison with Example 1, the outer circumferential portions of the flanges were fitted into the inner circumferential portions of end portions of a substrate for a photosensitive body manufactured in the same manner as in Example 1, and the distance between the photosensitive drum and a developing roll was measured in 8 points in the circumferential direction of the photosensitive body and in 3 points in the axial direction. Consequently, the distance (mm) between the photosensitive drum and the developing roll was average=0.201 and σ=0.032.

This photosensitive drum was used to form images. Consequently, the images were too strong in light and shade.

Comparative Example 2

In order to compare the state where oscillating noises were generated in an image forming apparatus using a contact electrifier, a photosensitive drum including a substrate of aluminum metal (A1050) having the same size as that in Example 2 was manufactured. Surface finishing of the substrate was performed by honing in the same manner as the above-mentioned. After the surface was made rough by the finishing, a photosensitive layer was formed in the same manner as in Example 2.

Flanges were fitted to the thus obtained photosensitive drum in the same manner as in Comparative Example 1. The photosensitive drum was mounted on a laser printer used in Example 2 and altered so that a voltage can be turned on/off manually, and evaluation was performed. The evaluation was performed by using a sound pressure meter installed at a position 30 cm on this side of and 40 cm above the laser printer. The frequency evaluated was twice as high as the frequency of a power supply.

Table 11 shows the result of the evaluation.

TABLE 11

| On/Off of Power of Contact Electrifier | Sound Pressure | Feeling of Sound |
|---|---|---|
| Off | 48.6 dB | Calm and comfortable sound |
| On | 62.4 dB | Very worrying oscillating sound, with troublesome level as a product |

EXAMPLE 10

A tube having an outer diameter of 19.8 mmϕ, a thickness of 0.4 mm and a length of 264 mm was manufactured in the same manner as in Example 1. Two slits 4.2 mm wide and 5.5 mm deep were formed in the end portions of this tube oppositely to each other in the circumferential direction. A photosensitive layer was formed on the obtained tube in the same manner as in Example 1, so as to obtain a photosensitive drum. This photosensitive drum was supported as shown in FIG. 13, and mounted in an electronic photographic apparatus having a driving structure. Copying was performed, and then superior images can be obtained.

According to the present invention, supporting and driving are based on an outer circumferential portion of a substrate of a photosensitive body, so that total deflection can be improved, and oscillating noises can be prevented from being generated even if a contact member is used to drive.

Since a photosensitive body with flanges is constituted by fitting the inner circumferential portions of the flanges onto the outer circumferential portions of the end portions of a substrate as mentioned above, even if it is a photosensitive body with flanges using any substrate such as an electro-unite tube subjected to TIG-welding, or the like, the size accuracy is superior, and the total deflection is improved. In addition, it is possible to prevent oscillating noises from being generated when a contact electrification system or a cleaning blade is used. In addition, the flanges are detachable easily, and the photosensitive body can be reclaimed and recycled. If flanges are not used, it is possible and advantageous to recycle the photosensitive body.

What is claimed is:

1. A photosensitive drum comprising:

a substrate comprising a worked electro-unite tube formed by at least one of drawing and extruding an electro-unite made from at least one of a metal strip and a metal plate cylindrically rolled up; and a photosensitive layer formed on said substrate;

wherein said photosensitive drum is rotatable by direct contact with an outer circumference of said substrate and further wherein an inner circumference of said substrate has an unworked welding trace.

2. A photosensitive drum comprising;

a substrate comprising a worked electro-unite tube formed by at least one of drawing and extruding an electro-unite made from at least one of a metal strip and a metal plate cylindrically rolled up;

a photosensitive layer formed on said substrate; and a driving flange attached to an end of the outer circumference of said substrate;

wherein said photosensitive drum is rotatable by direct contact with an outer circumference of said substrate.

3. A photosensitive drum as claimed in claim 2, wherein said substrate has a drawn portion at an end of the outer circumference thereof.

4. A photosensitive drum as claimed in claim 2, wherein said substrate is comprised of at least one of stainless steel and brass.

5. A photosensitive drum as claimed in claim 2, wherein both straightness and roundness of a surface shape of said substrate is in the range of 0.080 to 0.002 mm, and the surface roughness is within the range of from 3.0 to 0.2 μm as Rmax.

6. A method for rotating a photosensitive drum comprising the step of:

rotating said photosensitive drum, with a plurality of rotation supporting members connected to an outer surface of a photosensitive body, said photosensitive body being part of such photosensitive drum and said photosensitive drum comprising a worked electro-unite tube formed by at least one of drawing and extruding a electro-unite made from at least one of a metal strip and a metal plate cylindrically rolled up.

7. A method for driving a photosensitive drum as claimed in claim 6, wherein said substrate is comprised of at least one of stainless steel and brass.

8. A method for driving a photosensitive drum as claimed in claim 6 further comprising the steps of:

contracting the outer surface of said photosensitive body with a disc-like member, said disc-like member being attached to an end portion of a developing roll of a developing device arranged oppositely to said photosensitive body and having an outer diameter larger than that of said developing roll; and rotating said disc-like member to position and rotate said photosensitive body.

9. A method for driving a photosensitive drum as claimed in claim 8, further comprising the step of:

contacting at least one of a roll-like and a plate-like electrification member with said photosensitive body to position said photosensitive body.

10. A method for driving a photosensitive drum as claimed in claim 6, further comprising the step of:

positioning said photosensitive body by a position roll for said photosensitive body.

11. A photosensitive drum unit as claimed in claim 6, wherein said worked electro-unite tube is formed by tungsten inert gas welding.

12. A photosensitive drum comprising:

a substrate comprising a worked electro-unite tube formed by at least one of drawing and extruding an electro-unite made from at least one of a metal strip and a metal plate cylindrically rolled up;

a photosensitive layer formed on said substrate; and wherein said photosensitive drum is rotatable by direct contact with an outer circumference of said substrate and further wherein said worked electro-unite tube is formed by tungsten inert gas welding.

* * * * *